US011678779B2

(12) United States Patent
Verhagen

(10) Patent No.: US 11,678,779 B2
(45) Date of Patent: Jun. 20, 2023

(54) VACUUM CLEANER ACCESSORY

(71) Applicant: MILWAUKEE ELECTRIC TOOL CORPORATION, Brookfield, WI (US)

(72) Inventor: Michael A. Verhagen, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 486 days.

(21) Appl. No.: 16/525,836

(22) Filed: Jul. 30, 2019

(65) Prior Publication Data

US 2020/0054180 A1 Feb. 20, 2020

Related U.S. Application Data

(60) Provisional application No. 62/718,588, filed on Aug. 14, 2018.

(51) Int. Cl.

| | |
|---|---|
| ***A47L 9/00*** | (2006.01) |
| ***A47L 9/06*** | (2006.01) |
| ***A47L 9/24*** | (2006.01) |
| *A47L 9/32* | (2006.01) |

(52) U.S. Cl.

CPC ..... *A47L 9/0072* (2013.01); *A47L 9/0693* (2013.01); *A47L 9/242* (2013.01); *A47L 9/322* (2013.01)

(58) Field of Classification Search

CPC ..... A47L 5/24; A47L 9/0072; A47L 9/0693; A47L 9/242; A47L 9/322

See application file for complete search history.

(56) References Cited

U.S. PATENT DOCUMENTS 2,815,525 A * 12/1957 Einar ..... A47L 9/02 15/422
3,108,311 A * 10/1963 House ..... A47L 9/068 15/399
4,897,894 A * 2/1990 Fahlen ..... A47L 9/068 15/365

(Continued)

FOREIGN PATENT DOCUMENTS

CN 101731997 A 6/2010
CN 101731997 A * 6/2010

(Continued)

OTHER PUBLICATIONS

CN-102485154-A—English Machine Translation (Year: 2012).*
DE-102008034458-A1—English Machine Translation (Year: 2010).*

*Primary Examiner* — Marc Carlson
(74) *Attorney, Agent, or Firm* — Michael Best & Friedrich LLP

(57) ABSTRACT

An accessory tool for a vacuum cleaner includes a conduit and a nozzle. The conduit includes a first end coupled to the vacuum cleaner and a second end opposite the first end. The nozzle is coupled to the second end and includes a first portion with a first set of teeth and a first channel with an opening opposite the first set of teeth. The nozzle also includes a second portion with a second set of teeth and a second channel with an opening opposite the second set of teeth. The first set of teeth interlock with the second set of teeth, and are configured to cause the first portion and the second portion to pivot together relative to the conduit between a closed position and an open position. The nozzle is movable along an outer surface of the conduit from the second end toward the first end.

19 Claims, 7 Drawing Sheets

(56) References Cited

U.S. PATENT DOCUMENTS 5,398,361 A * 3/1995 Cason ..... E04H 4/1636 15/415.1
5,502,870 A * 4/1996 Ragner ..... A47L 9/068 15/393
5,826,301 A * 10/1998 Kang ..... A46B 5/0075 15/420
5,832,559 A * 11/1998 Kang ..... A47L 9/0673 15/420
6,536,076 B2 * 3/2003 Scian ..... A47L 9/02 15/418
6,820,305 B2 * 11/2004 Albert ..... A47L 9/0633 15/415.1
6,991,262 B1 * 1/2006 Ragner ..... A47L 9/0673 285/280
D603,570 S * 11/2009 Svantesson ..... D32/32
7,954,202 B1 * 6/2011 Ragner ..... A47L 9/068 15/416
8,402,602 B2 * 3/2013 Jonsson ..... A47L 9/068 15/400
9,723,960 B2 * 8/2017 Borges ..... A47L 9/0606
2004/0025289 A1 * 2/2004 Virgili ..... A47L 9/02 15/415.1
2004/0237250 A1 * 12/2004 Lim ..... A47L 9/02 15/415.1
2005/0081327 A1 * 4/2005 Lim ..... A47L 9/02 15/415.1
2005/0086764 A1 * 4/2005 Lim ..... A47L 9/02 15/415.1
2006/0107488 A1 * 5/2006 Lee ..... A47L 9/02 15/415.1
2013/0167322 A1 * 7/2013 Huang ..... A47L 9/02 15/418
2015/0320275 A1 * 11/2015 Borges ..... A47L 9/0606 134/21
2017/0112343 A1 * 4/2017 Innes ..... A47L 9/0009
2018/0125317 A1 * 5/2018 Lutz ..... A47L 9/0686

FOREIGN PATENT DOCUMENTS

CN 201564420 U 9/2010
CN 102485154 A * 6/2012
CN 106214067 A 12/2016
CN 106214067 A * 12/2016
CN 205923907 U * 2/2017
CN 205923907 U 2/2017
CN 206548436 U 10/2017
CN 206548436 U * 10/2017
CN 106214067 B * 1/2019 ..... A47L 9/00
DE 4413071 C2 10/1995
DE 19912451 B4 9/2000
DE 102008034458 A1 * 1/2010 ..... A47L 9/02
EP 1222892 A1 * 7/2002 ..... A47L 9/02
EP 1222892 B1 7/2002
EP 1314388 A1 * 5/2003 ..... A47L 9/02
EP 1314388 B1 11/2006
EP 2823745 A1 * 1/2015 ..... A47L 9/02
EP 2823745 A1 1/2015
EP 3272262 A1 * 1/2018 ..... A47L 9/02
EP 3272262 A1 1/2018
FR 2790936 A1 * 9/2000 ..... A47L 9/02
WO WO-2007086798 A1 * 8/2007 ..... A47L 9/242

* cited by examiner

VACUUM CLEANER ACCESSORY

CROSS-REFERENCE TO RELATED APPLICATION

This application claims the benefit of prior-filed U.S. Provisional Patent Application No. 62/718,588, filed Aug. 14, 2018, the entire contents of which are hereby incorporated by reference.

BACKGROUND

The present disclosure relates to an accessory tool for a vacuum cleaner that is movable between a first cleaning position and a second cleaning position.

SUMMARY

In one embodiment, an accessory tool for a vacuum cleaner includes a conduit and a nozzle. The conduit includes a first end coupled to the vacuum cleaner and a second end opposite the first end. The nozzle is coupled to the second end and includes a first portion with a first set of teeth and a second portion with a second set of teeth. The first portion has a first channel with an opening opposite the first set of teeth. The second portion has a second channel with an opening opposite the second set of teeth. The first set of teeth interlock with the second set of teeth. The interlocked first set of teeth and second set of teeth are configured to cause the first portion and the second portion to pivot together relative to the conduit between a closed position and an open position. The opening of the first channel is positioned adjacent to the opening of the second channel in the closed position. The opening of the first channel is pivoted apart from the opening of the second channel in the open position. The nozzle is movable along an outer surface of the conduit from the second end toward the first end.

In another embodiment, an accessory tool for a vacuum cleaner includes a rigid conduit, a nozzle, and an attachment coupled between the conduit and the nozzle. The conduit includes a first end coupled to the vacuum cleaner and a second end opposite the first end. The nozzle is coupled to the second end and includes a first portion and a second portion that are pivotable together relative to the conduit between a first cleaning position and a second cleaning position. The attachment is coupled between the conduit and the nozzle. The attachment includes a first part that has a first passageway with a first axis that extends through a center of the first passageway. The attachment also includes a second part that has a second passageway with a second axis that extends through a center of the second passageway. The second part is pivotably coupled to the first part, and is movable between a first position and a second position. The rigid conduit is configured to move along the first axis through the first passageway and along the second axis through the second passageway in the first position. The rigid conduit is unable to move along the second axis through the second passageway in the second position. The nozzle is movable along an outer dimension of the conduit between an operating position and a storage position while the attachment is in the first position.

In yet another embodiment, an accessory tool for a vacuum cleaner includes a nozzle configured to contact a surface to be cleaned that includes a hub, a first portion, and a second portion. The hub is removably coupled to the vacuum cleaner. The first portion is supported on the hub and includes a first channel and a first set of teeth that are positioned opposite an opening of the first channel. The second portion is supported on the hub and includes a second channel and a second set of teeth that are positioned opposite an opening of the second channel. The first set of teeth interlock with the second set of teeth and are configured to cause the first portion and the second portion pivot together relative to the hub between a closed positon and an open position. The opening of the first channel is positioned adjacent to the opening of the second channel in the closed position. The opening of the first channel is pivoted apart from the opening of the second channel in the open position.

Other aspects of the disclosure will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In general, the present disclosure relates to an attachment for a vacuum cleaner. The attachment is moveable between a first position and a second position to allow a user the ability to clean a variety of areas.

Figure 1:
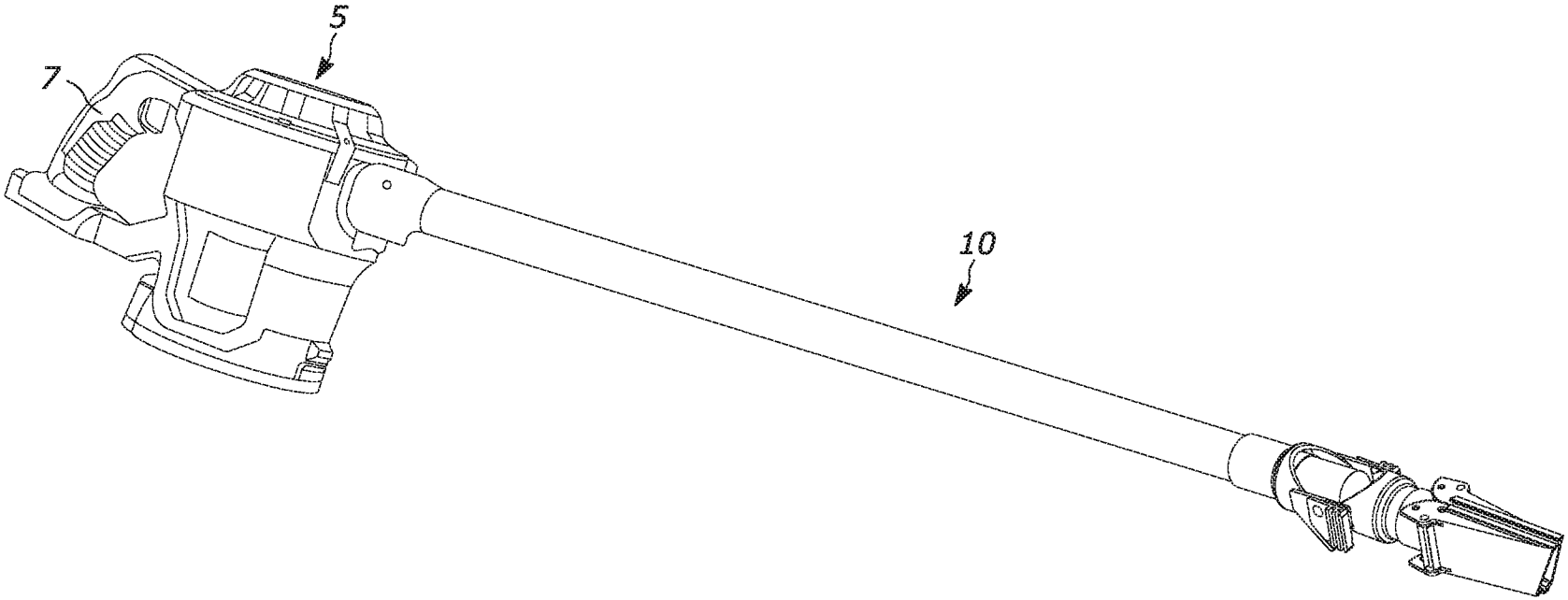
FIG. 1 is a perspective view of a vacuum cleaner coupled to an accessory tool.

As shown in FIG. 1, a cleaning tool 5 (e.g., a handheld vacuum cleaner) is coupled to an accessory tool 10 and used to clean a surface. The cleaning tool 5 includes a source of suction (not shown) that may draw air and debris through the accessory tool 10 and into a container (e.g., a dirt cup—not shown) within the cleaning tool 5. The cleaning tool 5 includes a handle 7 that a user may grip in order to direct the suction.

Figure 2:
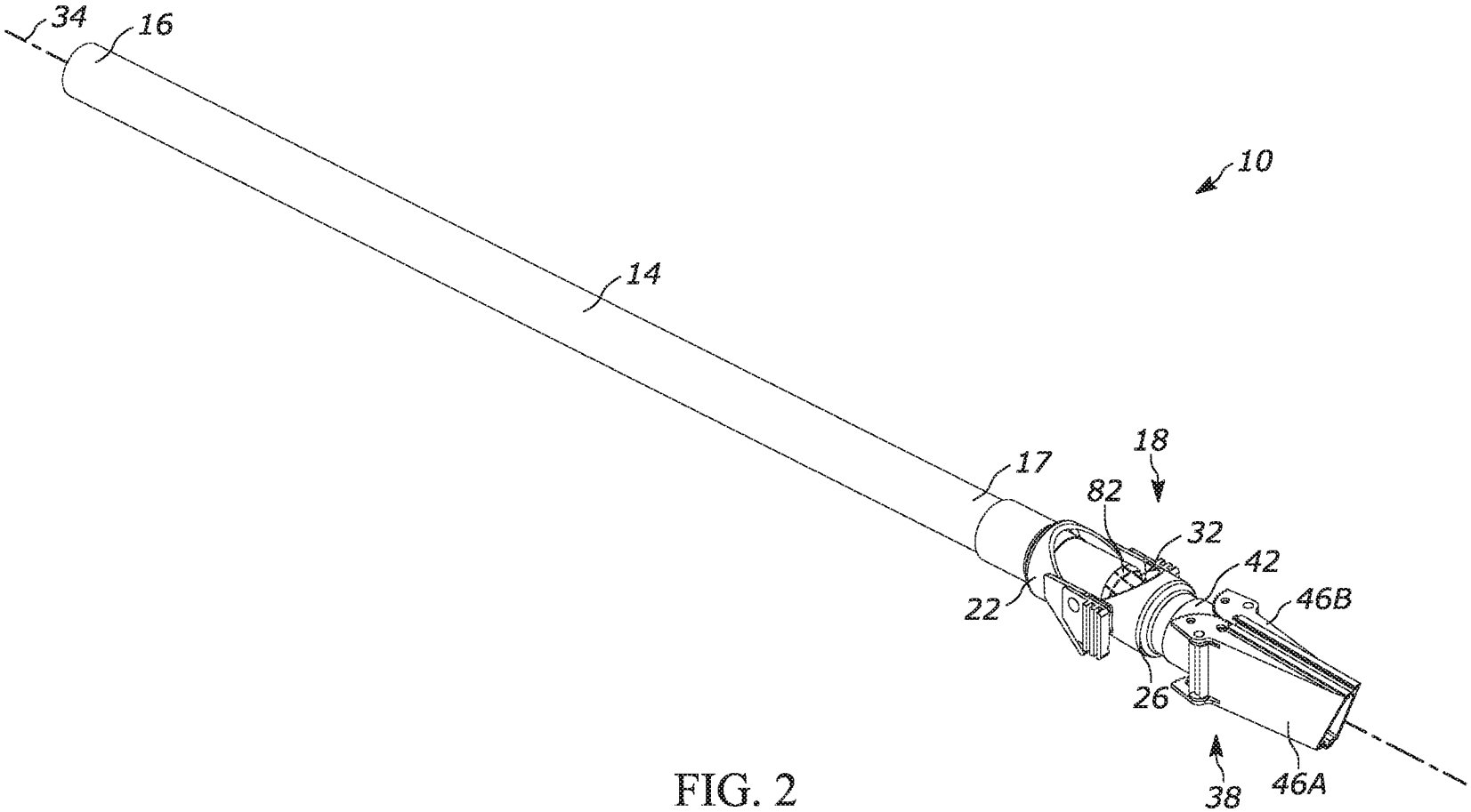
FIG. 2 is a perspective view of the accessory tool for the vacuum cleaner of FIG. 1, in a first cleaning positon.

As shown in FIG. 2, the accessory tool 10 includes a conduit or cleaning wand 14. The wand 14 includes a first end 16 that is configured to attach to the vacuum cleaner 5 and a second end 17 that extends away from the first end. In the illustrated embodiment, the wand 14 is a rigid member, although in other embodiments, the wand 14 may be flexible or bendable.

An attachment or knuckle 18 is coupled to the wand 14. In the illustrated embodiment, the knuckle 18 includes a first part 22 and a second part 26. Each part 22, 26 includes a passageway 30 (FIGS. 3A and 3B) that extends through a body of each part 22, 26. The passageways 30 are substantially the same size and shape as the wand 14 (e.g., circular). In the illustrated embodiment, a flexible tube or hose 32 extends from the first part 22 to the second part 26 to provide fluid communication between the passageways 30 of the first and second parts 22, 26.

Figure 3A:
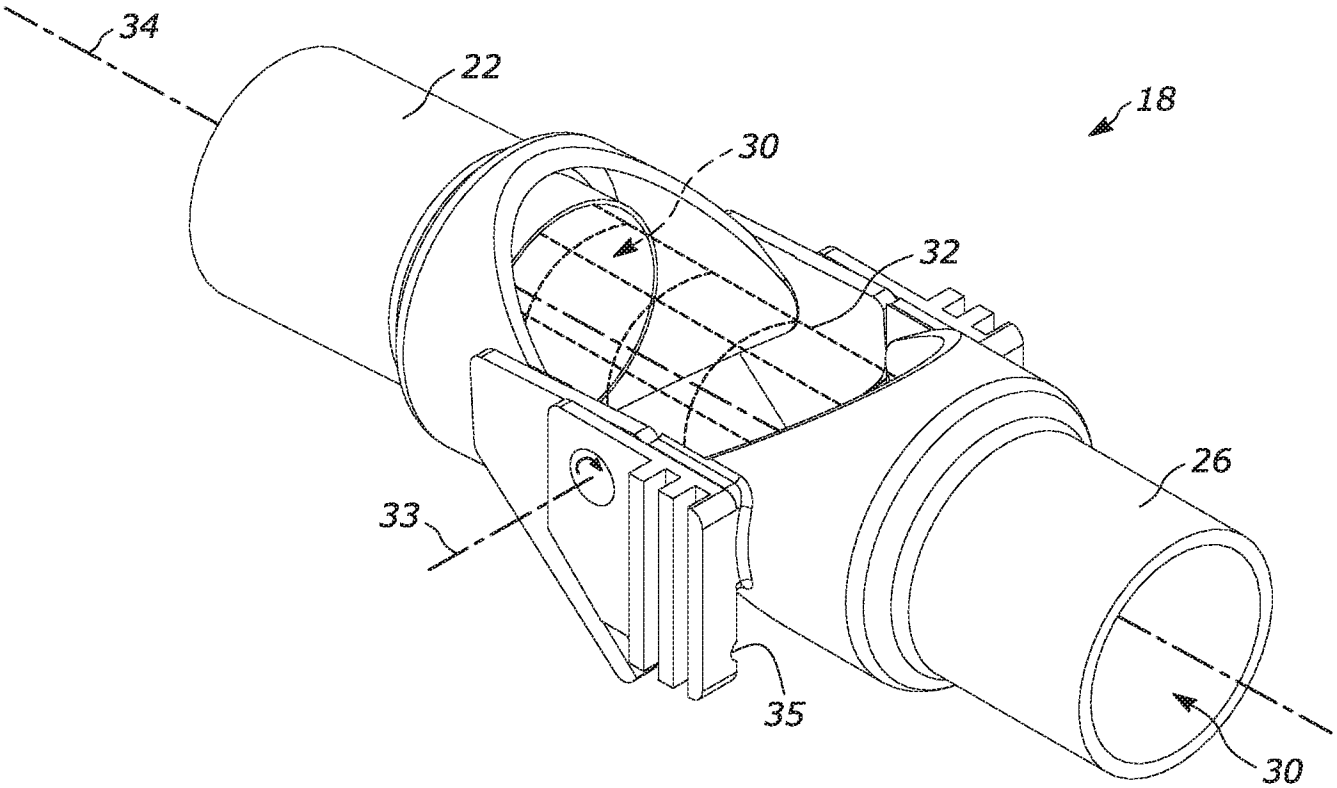
FIG. 3A is a perspective view of an attachment member of the accessory tool of FIG. 2, in a first position.
Figure 3B:
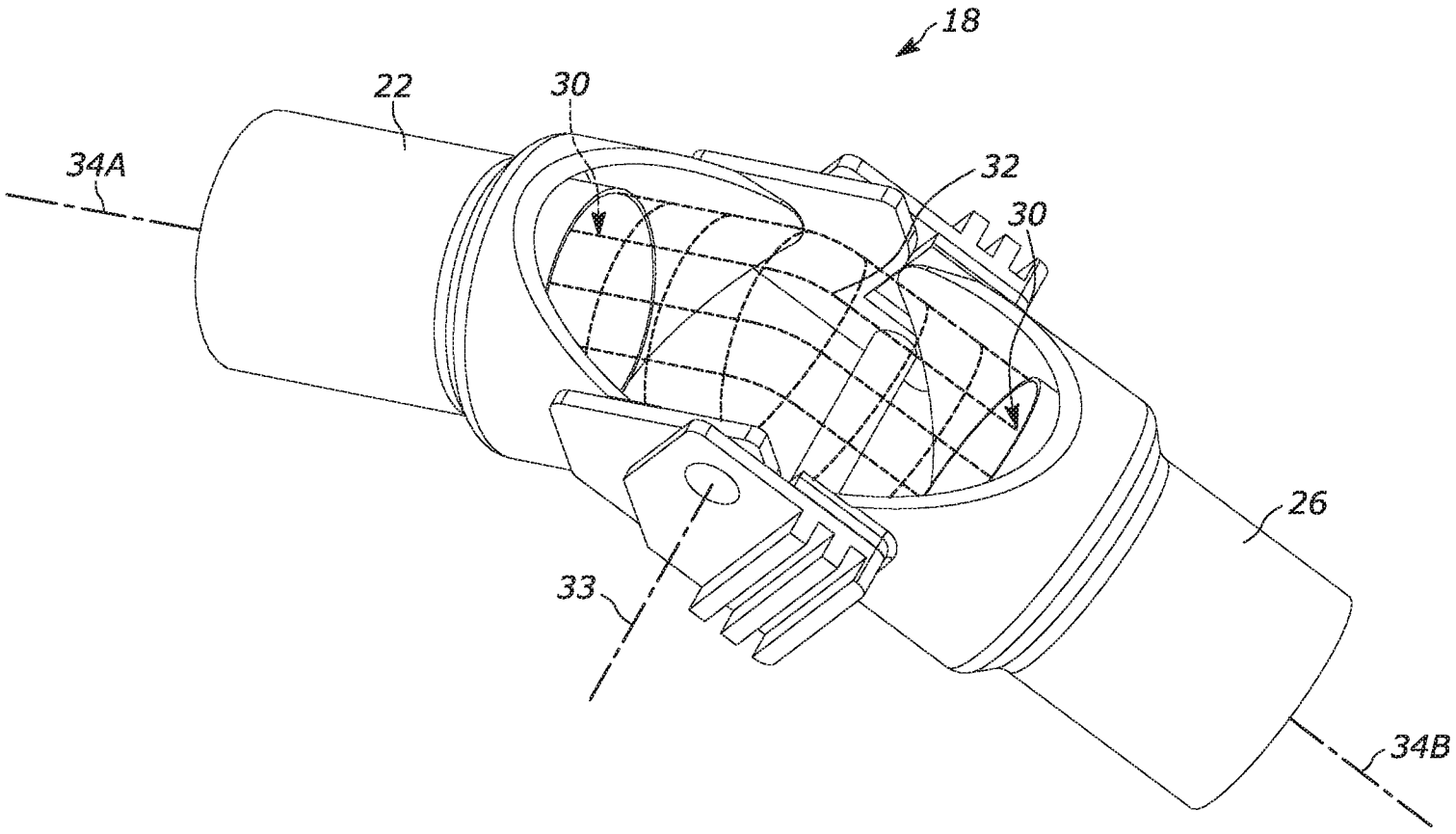
FIG. 3B is a perspective view of the attachment member of FIG. 3A, in a second position.

As shown in FIGS. 3A and 3B, the first part 22 is pivotable relative to the second part 26 about a first axis of rotation 33. In a first position (FIG. 3A), the passageway 30 of each part 22, 26 is aligned along a common axis 34. Additionally, the flexible hose 32 is also aligned along the axis 34. In the second position (FIG. 3B), an axis 34*a* that extends through the passageway 30 of the first part 22 is oblique with respect to an axis 34*b* that extends through the passageway 30 of the second part 26. In the second position, the flexible hose 32 bends as the parts 22, 26 move with respect to one another. The first part 22 includes a channel 35 that receives a projection 36 (FIG. 5) of the second part 26 in the second position. In the illustrated embodiment, the channel 35 includes a semi-circular shape. The engagement of the channel 35 and the projection 36 limit further rotational movement of the first part 22 with respect to the second part 26, and help maintain the knuckle 18 in the second position.

Figure 4:
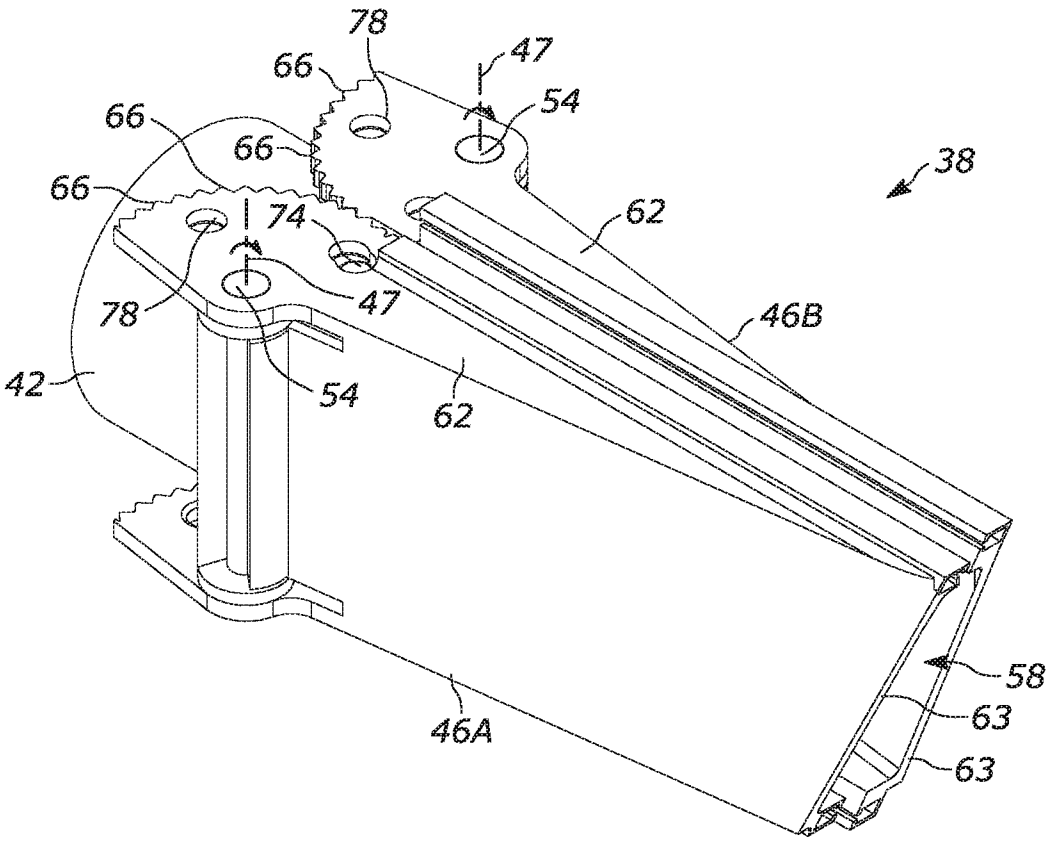
FIG. 4 is a perspective view of a nozzle of the accessory tool of FIG. 2.

As shown in FIGS. 2 and 4, a nozzle 38 is coupled to the knuckle 18. In the illustrated embodiment, the nozzle 38 includes a hub 42, a first portion 46*a*, and a second portion 46*b*. The hub 42 includes a passageway 50 (FIG. 5) that slides onto the second part 26 and is coupled to the knuckle 18 (e.g., via a friction fit, a detent, a latch, etc.).

The first portion 46*a* and the second portion 46*b* are movable coupled to the hub 42. In the illustrated embodiment, hub 42 includes pins 54, and the first portion 46*a* and the second portion 46*b* are pivotable about the pins 54 about a second axis of rotation 47 that extends through a plane that is generally orthogonal with respect to the first axis of rotation 33. In other words, the first and second parts 22, 26 pivot in a first direction and the first and second portions 46*a*, 46*b* pivot in a second direction. Each portion 46*a*, 46*b* includes a channel 58 defined by two side surfaces 62 and an end surface 63. In the illustrated embodiment, a portion of each side surface 62 is arcuate or curved and includes teeth 66. In some embodiments, the teeth 66 extend around an arc of 90°, while in other embodiments, the teeth 66 may extend greater than or less than 90°.

FIG. 2 illustrates a first cleaning position for the nozzle 38. In the first cleaning position, the side surfaces 62 of the first portion 46*a* and second portion 46*b* are adjacent to or contacting one another. The channels 58 are aligned in a facing relationship to define a common channel that extends along the axis 34 (e.g., openings to the channels 58 are adjacent one another). The first cleaning position defines a narrow profile and allows the accessory tool 10 to clean tight areas or crevices. In the first cleaning position, only the end surfaces 63 of the first and second portions 46*a*, 46*b* are exposed to a surface to be cleaned. A cleaning area of the first cleaning position is defined as the opening between the adjacent end surfaces 63 (e.g., the area of the channels 58).

Figure 5:
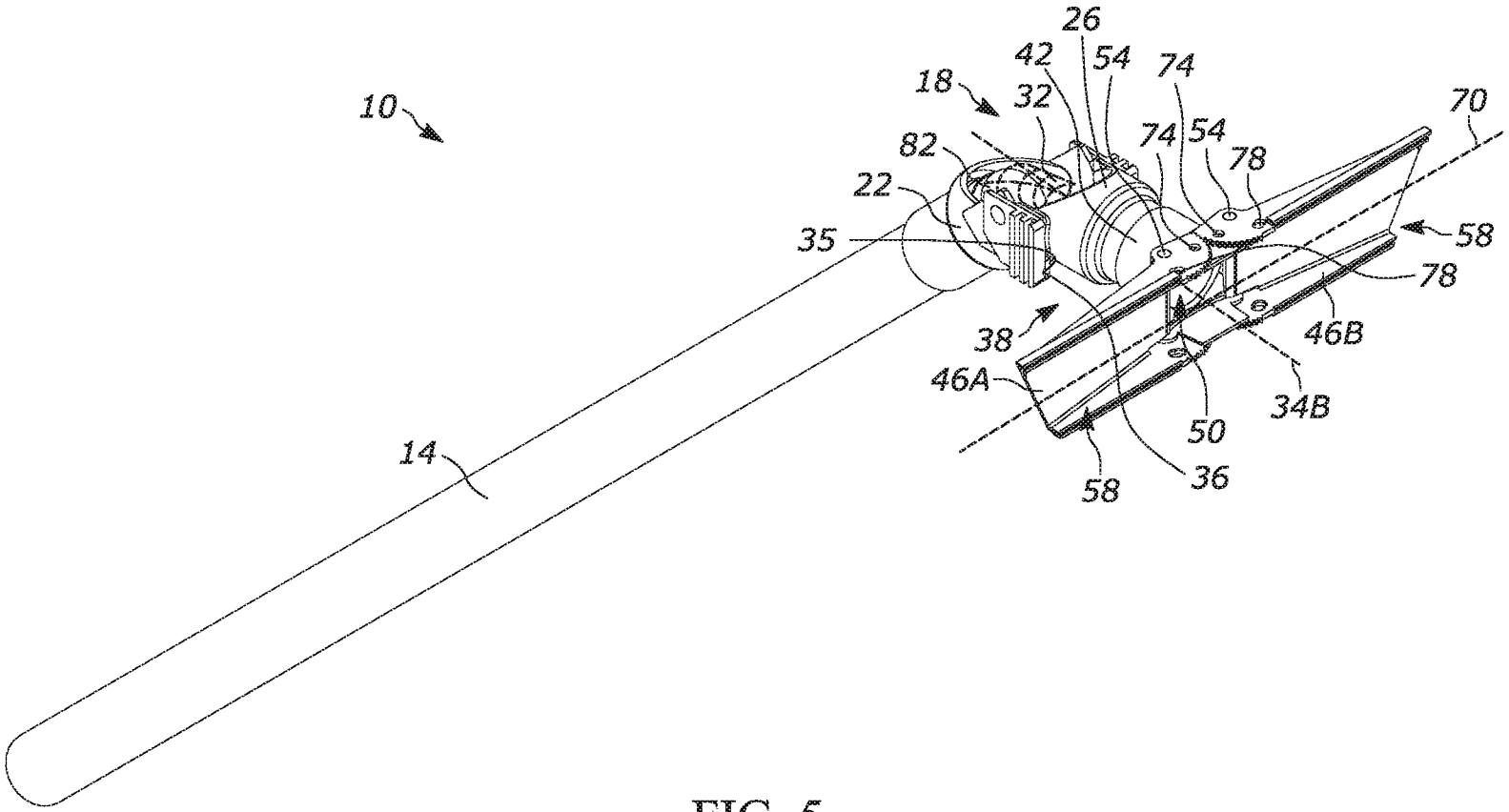
FIG. 5 is a perspective view of the accessory tool of FIG. 2, in a second cleaning position.

As shown in FIG. 5, the first and second portions 46*a*, 46*b* are pivotable to a second cleaning position. In the illustrated embodiment, each portion 46*a*, 46*b* is pivotable approximately 90° in opposite directions (e.g., the first portion 46*a* pivots approximately 90° clockwise and the second portion 46*b* pivots 90° counterclockwise). As the portions 46*a*, 46*b* pivot, the teeth 66 on the first portion 46*a* engage the teeth 66 on the second portion 46*b*. Teeth 66 allow a user grasp one the portions 46*a*, 46*b*, and cause both of the portions 46*a*, 46*b* to pivot as well. In other words, a user only needs to grasp one portion 46*a*, 46*b* in order to rotate both portions 46*a*, 46*b*. In the second cleaning position, each channel 58 extends along an axis 70 substantially perpendicular to the axis 34*b*. The side surfaces 62 and the end surface 63 of each portion 46*a*, 46*b* are exposed to the surface to be cleaned. A cleaning area of the second cleaning position is defined as the area between the side surface 62 and between each end surface 63. The cleaning area of the second cleaning position is greater than the cleaning area of the first cleaning position.

A detent 74 on the hub 42 engages an aperture 78 on each portion 46*a*, 46*b* to lock the first and second portions 46*a*, 46*b* in the second cleaning position. The second cleaning position provides a wide cleaning area along the length of axis 70 and has a larger surface area than the first cleaning position. The second cleaning position can be used to clean floors (e.g., hardwood floors).

In both the first cleaning position (FIG. 2) and the second cleaning position (FIG. 5), the wand 14 extends only into the passageway 30 of the first part 22, allowing the knuckle to pivot between the first position (FIG. 3A) and the second position (FIG. 3B). The user may pivot the knuckle 18 in order to allow for more ergonomic usage. The flexible hose 32 provides fluid communication between the passageways 30 of the first and second portions 46*a*, 46*b* and the passageway 50 of the hub 42. This allows the vacuum cleaner (not shown) to suction air and debris within the channels 58 up through the wand 14.

Figure 6:
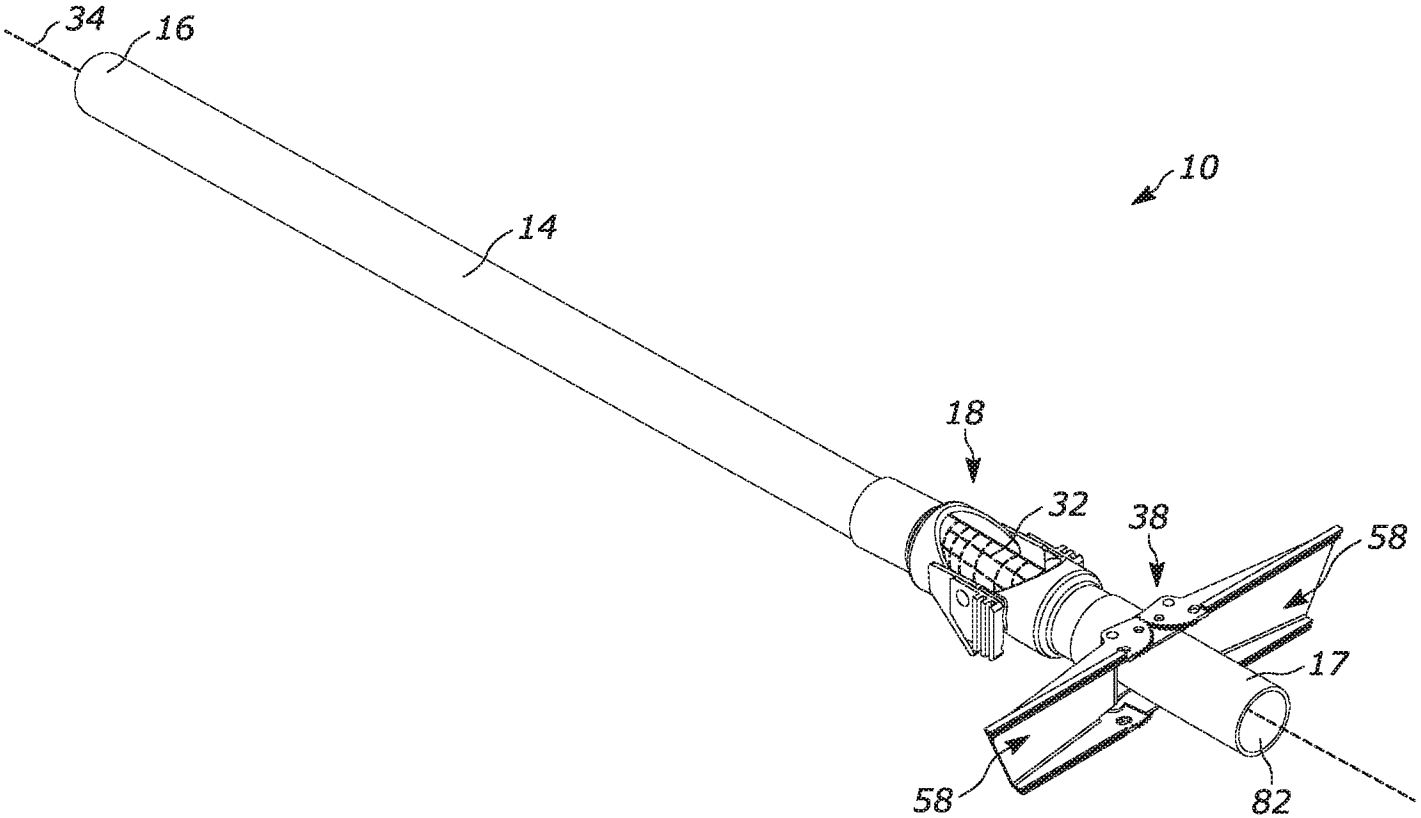
FIG. 6 is a perspective view of the accessory tool of FIG. 2, in a storage position.

As shown in FIG. 6, the user can move the nozzle 38 to a storage position when the nozzle 38 is no longer required (e.g., because the user wants to use an alternate accessory). In the illustrated embodiment, the knuckle 18 and the nozzle 38 remain coupled to the wand 14 while moving between the operating position (FIGS. 2 and 5) and the storage position. With the knuckle 18 in the first position (FIG. 3A), a user may slide the wand 14 through the passageways 30, 50 and the flexible hose 32. The portions 46*a*, 46*b* move toward or into the second cleaning position, allowing the wand 14 to slide past the channels 58. The nozzle 38 and knuckle 18 are stored on wand 14 and away from an end 82 of the wand 14, thereby allowing the wand 14 to be used by alone or with other attachments. The user may slide the knuckle 18 and nozzle 38 back toward the end 82 of the wand 14 to continue to use the nozzle 38.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

The invention claimed is:

1. An accessory tool for a vacuum cleaner comprising:

a conduit including a first end coupled to the vacuum cleaner and a second end opposite the first end; and a nozzle coupled to the second end and including, a first portion having a first channel and a first set of teeth opposite an opening of the first channel, the first portion pivotable relative to the conduit, and a second portion having second channel and a second set of teeth interlocked with the first set of teeth and disposed opposite an opening of the second channel, the second portion pivotable relative to the conduit;

wherein the interlocked first set of teeth and second set of teeth are configured to cause the first portion and the second portion to pivot together between a closed position and an open position, the opening of the first channel positioned adjacent the opening of the second channel in the closed position, and the opening of the first channel pivoted apart from the opening of the second channel in the open position;

wherein the nozzle being further moveable along an outer surface of the conduit from the second end toward the first end;

wherein, in the closed position, the second portion seats against the first portion such that the opening is a substantially planar opening of a crevice tool; and wherein, in the closed position, the first channel and the second channel are aligned in a facing relationship to define a common channel, wherein the substantially planar opening is angled obliquely relative to a direction of airflow through the common channel.

2. The accessory tool of claim 1, further comprising an attachment coupled between the conduit and the nozzle, wherein the attachment includes a first part and a second part pivotably coupled to the first part and moveable between a first position and a second position.

3. The attachment tool of claim 2, wherein an axis of rotation of the nozzle extends along a plane generally orthogonal with respect to an axis of rotation of the attachment.

4. The accessory tool of claim 2, wherein the first part and the second part are each rotatable approximately 90° between the first position and the second position.

5. The accessory tool of claim 1, wherein the conduit is a rigid member.

6. The accessory tool of claim 1, further comprising a flexible hose coupled to the nozzle, and providing fluid communication between the conduit and the first channel and the second channel, the flexible hose movable along the conduit toward the second end with the nozzle.

7. The accessory tool of claim 1, wherein the nozzle further includes a hub supporting the first portion and the second portion, the hub includes a first detent and the first portion includes a first opening, the first detent selectively engaging the first aperture in the open position in order to secure the nozzle in the second cleaning position.

8. An accessory tool for a vacuum cleaner comprising:

a rigid conduit including a first end coupled to the vacuum cleaner and a second end opposite the first end;

an attachment slidingly attached to the rigid conduit, the attachment including a first part having a first passageway with a first axis extending through a center of the first passageway and a second part having a second passageway with a second axis extending through a center of the second passageway, the second part being pivotably coupled to the first part and movable between:

a first position in which the rigid conduit is configured to move along the first axis through the first passageway and along the second axis through the second passageway, and a second position in which the rigid conduit is unable to move along the second axis through the second passageway; and a nozzle coupled to the attachment and including a first portion and a second portion that are pivotable together relative to the conduit between a first cleaning position and a second cleaning position;

wherein the nozzle and the attachment are moveable along an outer surface of the conduit toward the first end when the attachment is in the first position.

9. The accessory tool of claim 8, wherein an axis of rotation of the nozzle extends along a plane generally orthogonal with respect to an axis of rotation of the attachment.

10. The accessory tool of claim 8, wherein the first portion includes a first set of teeth and the second portion includes a second set of teeth interlocked with the first set of teeth.

11. The accessory tool of claim 8, wherein the first part and the second part are each rotatable approximately 90° between the first position and the second position.

12. The accessory tool of claim 8, wherein a flexible tube extends between the first passageway and the second passageway in order to provide fluid communication between the conduit and the nozzle.

13. The accessory tool of claim 8, wherein the first axis and the second axis are collinear in the first position, and the first axis and the second axis are oblique in the second position.

14. The accessory tool of claim 8, wherein the first portion and the second portion pivot the same rotational distance.

15. The accessory tool of claim 8, wherein the nozzle further includes a hub supporting the first part and the second part, the hub includes a first detent and the first part includes a first opening, the first detent selectively engaging the first aperture in the second cleaning position in order to secure the nozzle in the second cleaning position.

16. The accessory tool of claim 8, wherein first portion includes a first channel with a first opening and the second portion includes a second channel with a second opening, the first opening positioned adjacent the second opening in the first cleaning position, and the first opening pivoted apart from the second opening in the second cleaning position.

17. An accessory tool for a vacuum cleaner comprising:

a nozzle configured to contact a surface to be cleaned, the nozzle including, a hub removably coupled to the vacuum cleaner, a first portion supported on the hub and including a first channel and a first set of teeth positioned opposite an opening of the first channel, the first portion pivotable relative to the hub, and a second portion supported on the hub and including a second channel and a second set of teeth positioned opposite an opening of the second channel, the second portion pivotable relative to the hub;

wherein the first set of teeth interlock with the second set of teeth and are configured to cause the first portion and the second portion pivot together between a closed positon where the opening of the first channel is positioned adjacent the opening of the second channel, and an open position where the opening of the first channel is pivoted apart from the opening of the second channel, and wherein the first portion includes a first aperture and the second portion includes a second aperture, the first aperture selectively engageable with a first detent on the hub to secure the first portion in the open position and the second aperture selectively engageable with a second detent on the hub to secure the second portion in the open position.

18. The accessory tool of claim 17, further comprising an attachment coupled to the nozzle, the attachment includes a first part and a second part pivotably coupled to the first part and movable between a first position and a second position independently of the nozzle.

19. The accessory tool of claim 17, further comprising a conduit having a first end coupled to the vacuum cleaner and a second end coupled to the hub, wherein the nozzle is moveable along an outer surface of the conduit toward the first end.

* * * * *